US008881543B2

(12) United States Patent
Hayashi

(10) Patent No.: US 8,881,543 B2
(45) **Date of Patent: *Nov. 11, 2014**

(54) DUCT TYPE AIR CONDITIONER

(75) Inventor: Yusuke Hayashi, Kawasaki (JP)

(73) Assignee: Fujitsu General Limited, Kawasaki-shi (JP)

( * ) Notice: Subject to any disclaimer, the term of this patent is extended or adjusted under 35 U.S.C. 154(b) by 589 days.

This patent is subject to a terminal disclaimer.

(21) Appl. No.: 12/902,214

(22) Filed: Oct. 12, 2010

(65) Prior Publication Data

US 2011/0138845 A1 Jun. 16, 2011

(30) Foreign Application Priority Data

Dec. 11, 2009 (JP) ..... 2009-281456

(51) Int. Cl.
*F25D 23/12* (2006.01)
*F24F 13/20* (2006.01)
*F24F 1/00* (2011.01)

(52) U.S. Cl.
CPC ..... *F24F 1/0007* (2013.01); *F24F 13/20* (2013.01); *F24F 1/0033* (2013.01); *F24F 2013/205* (2013.01)
USPC ..... 62/259.1; 62/314; 62/414

(58) Field of Classification Search
CPC ..... F24F 1/0007; F24F 13/20; F24F 1/0033; F24F 2013/205
USPC ..... 62/259.1, 314, 414; 165/127; 415/101, 415/102, 60–61
See application file for complete search history.

(56) References Cited

U.S. PATENT DOCUMENTS

| | | | | |
|---|---|---|---|---|
| 4,449,376 | A * | 5/1984 | Draper et al. | 62/259.1 |
| 6,082,131 | A * | 7/2000 | Hirosawa et al. | 62/448 |
| 6,997,005 | B2 * | 2/2006 | Haasis | 62/258 |
| 8,096,137 | B2 * | 1/2012 | Czerwonky et al. | 62/259.1 |

FOREIGN PATENT DOCUMENTS

| | | | |
|---|---|---|---|
| JP | 62299637 | A * | 12/1987 |
| JP | 04006341 | A * | 1/1992 |
| JP | 04006431 | A * | 1/1992 |
| JP | 2001227768 | A * | 8/2001 |
| JP | 2001227770 | A * | 8/2001 |

(Continued)

OTHER PUBLICATIONS

Jim Bryan, Reversing the Direction of Rotation on TEFC Motors, US Motors / Emerson Motor Technologies, Product Service Bulletin, vol. 12 (Jan. 2004).*

*Primary Examiner* — Mohammad M Ali
(74) *Attorney, Agent, or Firm* — Edwards Wildman Palmer LLP

(57) ABSTRACT

There is provided a duct type air conditioner that solves problems of assembling properties and serviceability.
The duct type air conditioner includes a front plate formed with a discharge duct mounting frame outwardly thereof so as to surround discharge openings, a fan mechanism mounted inwardly of the front plate by way of a fan panel interposed therebetween, a back plate formed with a suction duct mounting frame outwardly thereof so as to surround the suction opening, and a heat exchanger mounted inwardly of the back plate so as to face the fan mechanism. The fan mechanism includes two fan units having separate fan panels such as formed by dividing a fan panel into two panels, motors mounted on the respective separate fan panels, and fans positioned inwardly of the separate fan panels and driven by the motors. The respective fan units are mounted inwardly of the front plate by attaching the respective fan panels to the front plate on the inside thereof.

10 Claims, 7 Drawing Sheets

(56) References Cited

FOREIGN PATENT DOCUMENTS

| | | | | |
|---|---|---|---|---|
| JP | 2008075928 | A | * | 4/2008 |
| KR | 2000033827 | A | * | 6/2000 |
| KR | 2005064963 | A | * | 6/2005 |
| KR | 2009115278 | A | * | 11/2009 |
| WO | WO 2006080793 | A2 | * | 8/2006 |

* cited by examiner

DUCT TYPE AIR CONDITIONER

CROSS REFERENCE TO RELATED APPLICATIONS

This application is related to two co-pending applications: "DUCT TYPE AIR CONDITIONER" filed even date herewith in the name of Yusuke Hayashi claiming the right of priority under 35 U.S.C. §119 based on Japanese Patent Application No. 2009-281458; and "DUCT TYPE AIR CONDITIONER" filed even date herewith in the names of Futoshi Yamada and Katsuya Kato claiming the right of priority under 35 U.S.C. §119 based on Japanese Patent Application No. 2009-281457; which applications are assigned to the assignee of the present application and all three incorporated by reference herein.

BACKGROUND OF THE INVENTION

1. Field of the Invention

The present invention relates to a duct type air conditioner in which a fan mechanism thereof is improved.

2. Description of the Prior Art

As for a duct type air conditioner in the prior art, there is a technique to form an assembly of a fan panel by mounting mechanical components such as motors or fans to a single fan panel. Therefore, centering of mechanical components or collective mounting/separation of components has been performed by using such single fan panel as a reference.

If, however, mechanical components are mounted to a single fan panel in a large duct type air conditioner, the weight of an assembly is increased to such extent that one worker cannot handle the assembly, causing an assembling performance to deteriorate. Further, even when one component is to be replaced, it is needed to remove said single fan panel with the result that the handling of such air conditioner is required to be done with the same level of care as heavy objects with the result that the availability of a work space lowers and the working environment also deteriorates.

SUMMARY OF THE INVENTION

An object of the present invention is to provide a duct type air conditioner that solves problems of assembling performance and working environment by using a plurality of separate fan panels.

In order to achieve the above object, according to a first embodiment of the invention, there is provided a duct type air conditioner including at least: a casing having discharge openings and a suction opening therein, said casing being composed of a front plate formed with a discharge duct mounting frame outwardly thereof so as to surround said discharge openings; a fan mechanism mounted inwardly of said front plate by way of a fan panel interposed therebetween; said casing being further composed of a back plate formed with a suction duct mounting frame outwardly thereof so as to surround said suction opening; and a heat exchanger mounted inwardly of said back plate. The fan mechanism includes a plurality of fan units having separate fan panels such as formed by dividing a fan panel into a plurality of panels, motors mounted on said separate fan panels, and fans positioned inwardly of said separate fan panels to be driven by said motors. The plurality of fan units are provided inwardly of said respective discharge openings in the front plate by mounting the respective separate fan panels to said front plate.

According to a second embodiment of the invention, in the duct type air conditioner according to the first embodiment of the invention, said plurality of fan units include similar components such as the motors or the fans.

According to a third embodiment of the invention, in the duct type air conditioner according to the first or second embodiment of the invention, the motors of the fan units are mounted on the back surfaces of the separate fan panels by motor supports.

According to a fourth embodiment of the invention, in the duct type air conditioner according to any one of the first to third embodiments of the invention, the discharge openings are substituted by the suction opening, the suction opening is substituted by the discharge openings, the discharge duct mounting frame is substituted by the suction duct mounting frame, and the suction duct mounting frame is substituted by the discharge duct mounting frame.

According to the embodiments of the invention, a fan mechanism, requiring heavy motors, is formed of a plurality of fan units provided on a plurality of separate fan panels, respectively. Accordingly, the entire fan mechanism is downsized, and the total weight of each of the fan units can thus be reduced considerably. As a result, it is easier to handle and assemble the fan units. Further, a required die can be downsized, so that initial investment can also be reduced. Furthermore, at the time of repair, only one broken fan unit out of the plurality of fan units is needed to be removed from a front plate. After the repair, it is also easy to perform a maintenance service.

DETAILED DESCRIPTION OF THE EMBODIMENTS

Figure 1:
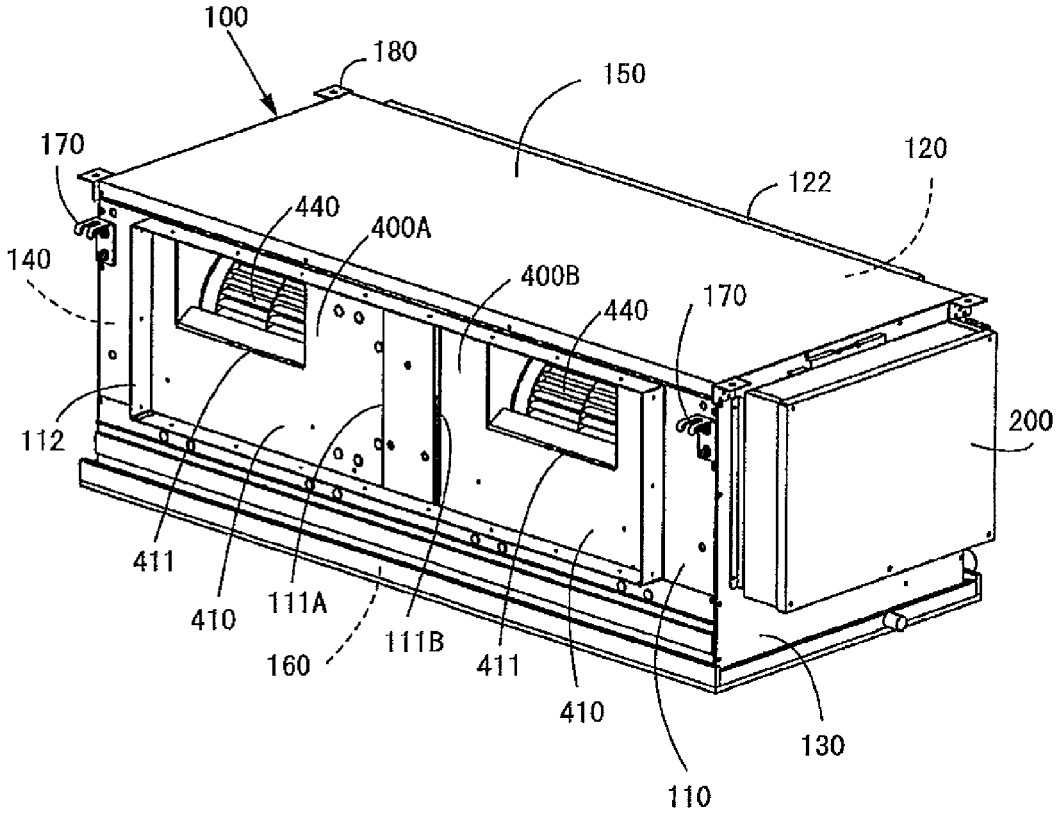
FIG. 1 is a perspective view of a duct type air conditioner according to an embodiment of the invention.

In FIG. 1, a casing 100 includes a front plate 110, a back plate 120, a right side plate 130 to mount an electric component box 200 thereonto, a left side plate 140, a top plate 150, and a bottom plate 160.

Figure 5:
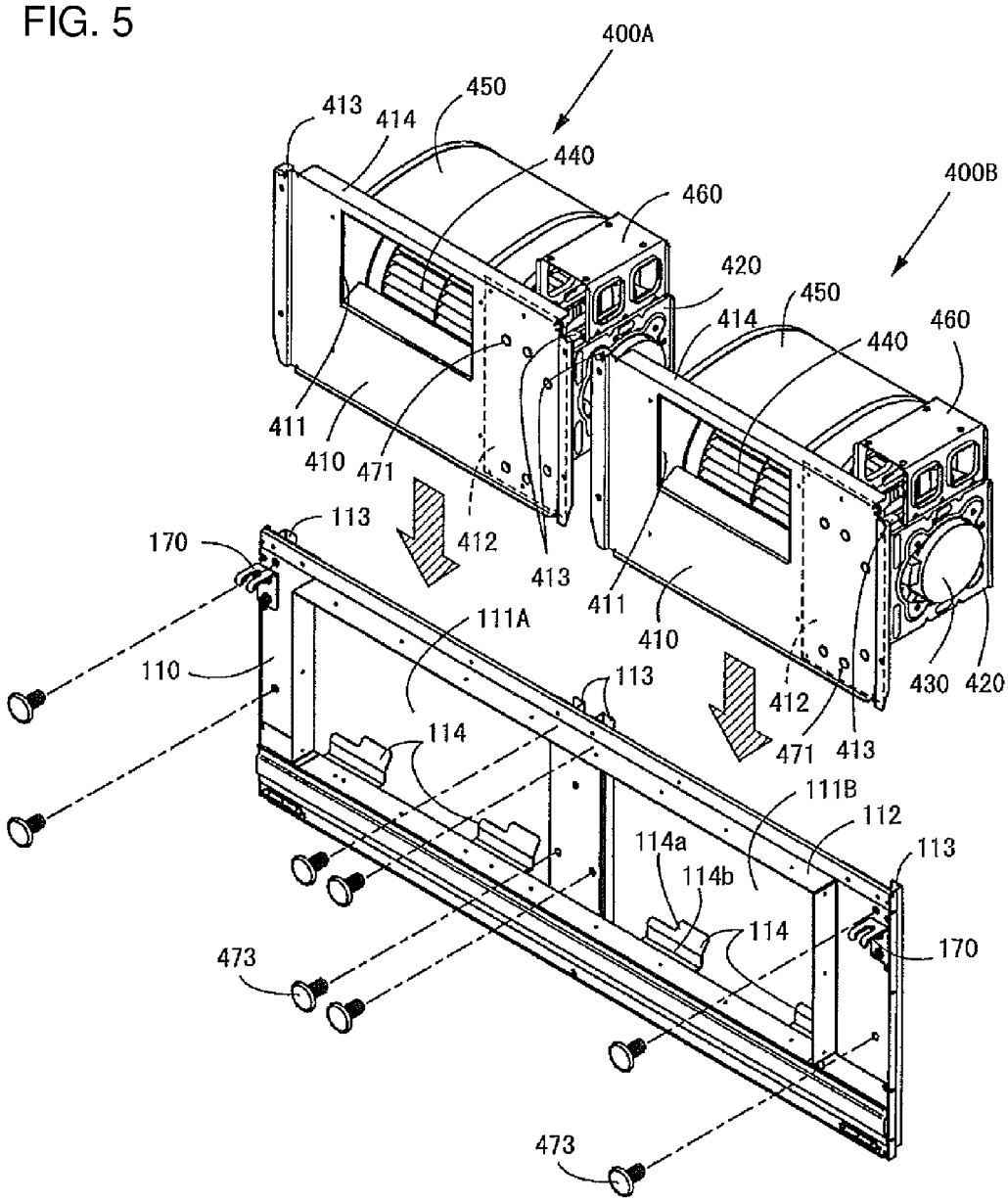
FIG. 5 is an exploded perspective view showing that the fan units are assembled with a front plate of the duct type air conditioner.

For example, as shown in FIG. 5, a discharge duct mounting frame 112 is mounted to the front plate 110 so as to integrally surround discharge openings 111A and 111B arranged so as to be spaced away from each other in a transverse direction. Hanging hooks 170 are attached to the front surface of the front plate 110 at both ends of the upper portion thereof. Further, a pair of vertical rails 113, which is bent in an L shape so that the inner portions thereof face each other, are provided on both sides of each of the discharge openings 111A and 111B inwardly of the front plate. Furthermore, panel retainers 114 are attached inwardly to the lower end of portions of each of the discharge openings 111A and 111B. Each of the panel retainers 114 includes an inclined surface portion 114*a* that is slightly opened inwardly and a stopper portion 114*b* that has the shape of a frame to form a bottom.

Figure 3:
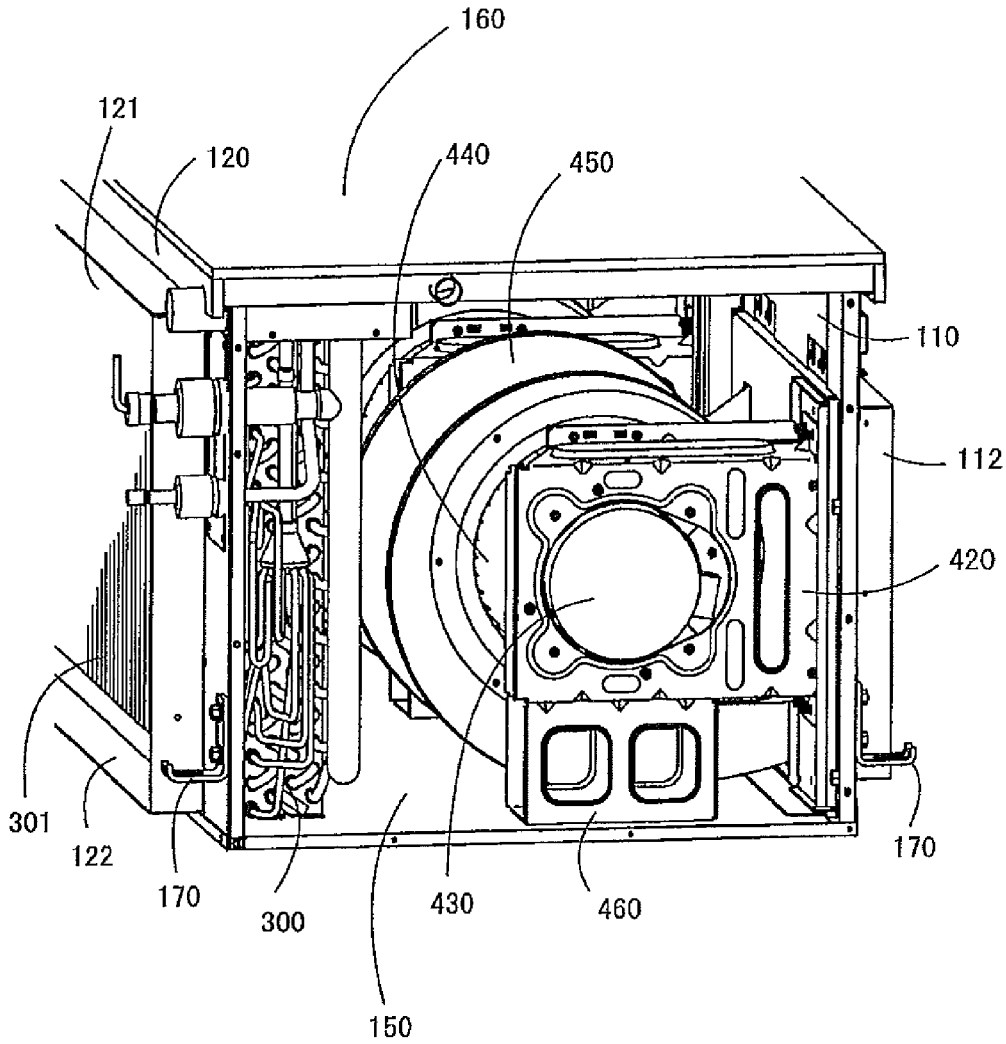
FIG. 3 is a partial perspective view of the duct type air conditioner from which a right side plate and an electric component box are removed and which is turned upside down.

For example, as shown in FIG. 3 showing the duct type air conditioner turned upside down, a suction duct mounting frame 122 is attached to the back plate 120 so as to surround a suction opening 121 through which a fin portion 301 of a heat exchanger 300 is exposed. Further, hanging hooks 170 are attached to the back plate 120 at both ends of the upper portion thereof (the lower portion in FIG. 3 showing the duct type air conditioner that is turned upside down).

Fan units 400A and 400B have the same structure and are independent of each other to form a fan mechanism. For example, as shown in FIGS. 2 to 5, each of the fan units 400A and 400B includes a fan panel 410, a motor support 420 mounted to the back surface of the fan panel 410, a DC motor 430 assembled with the motor support 420, a fan 440 that uses an output shaft of the DC motor 430 as a rotating shaft, a fan cover 450 that surrounds the fan 440 at portions other than where air is sucked and discharged, and a spacer 460 that is mounted on the motor support 420 to serve during the assembling and transport.

In the prior art, a partition plate is used for two fans 410 directly fixed thereto while in the present invention such two separate fan panels (divided fan panel) instead of the single partition plate are used for the separate fans. Each of the fan panels 410 includes a discharge port 411 formed at a position facing the fan 440, a reinforcing plate 412 attached to the inside of the fan panel beside the discharge port 411 in the transverse direction, press portions 413 bent inwardly from upper portions of both side ends of the fan panel 410, and a handle portion 414 as a handle bent inwardly of an upper end portion of the fan panel except for both side ends of the upper end portion. The discharge ports 411 have a size small enough to be positioned in the range of the discharge openings 111A and 111E of the front plate 110. The reinforcing plate 412 is to reinforce a portion of the corresponding fan panel 410, and the motor support 420 is attached to said reinforcing plate 412.

Figure 6:
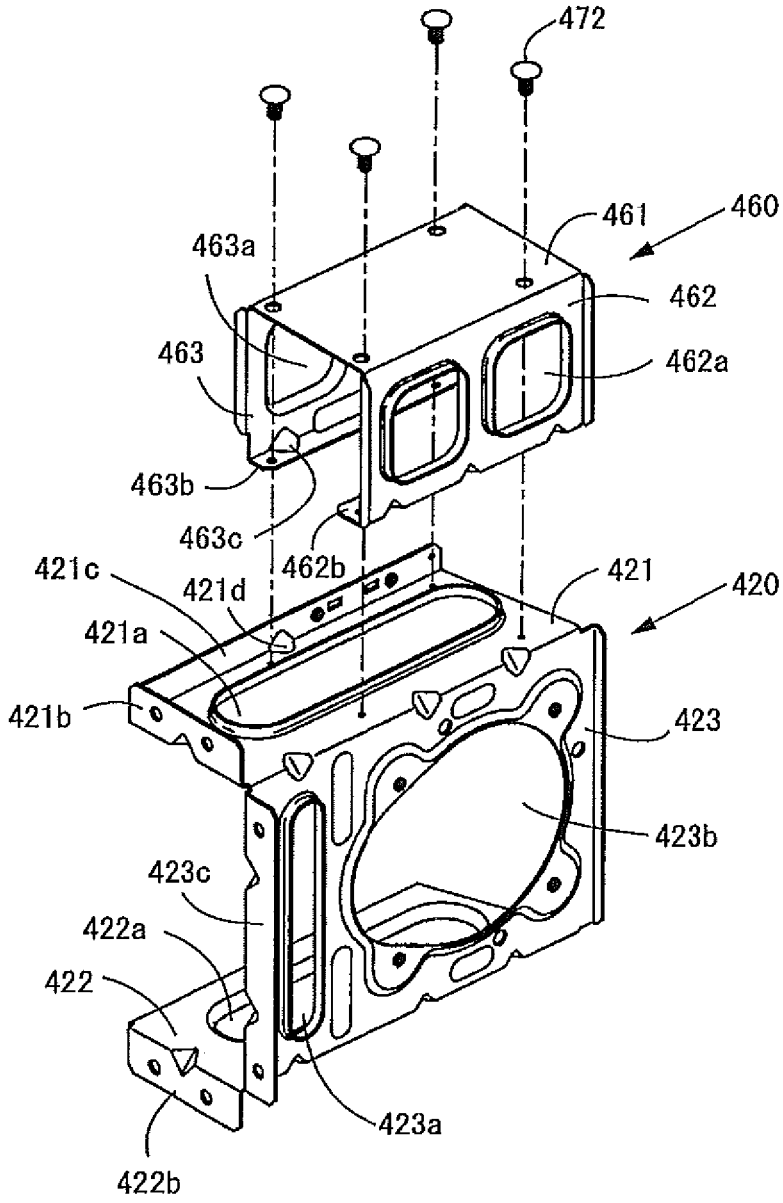
FIG. 6 is an exploded perspective view showing that a spacer is assembled with a motor supporting frame of the duct type air conditioner.

As shown in FIG. 6, the motor support 420 is formed by bending a metal plate into a U shape. The motor support includes a spacer mounting surface 421 on which the spacer 460 is mounted, a bottom portion 422, and a side portion 423. Air holes 421*a*, 422*a*, and 423*a* are formed respectively in the spacer mounting surface 421, the bottom portion 422, and the side portion 423 so as not to interrupt airflow generated by the fan 440. A mounting hole 423*b*, in order to mount the motor 430 therethrough, is formed in the side portion 423. In addition, mounting portions 421*b*, 422*b*, and 423*c*, which are to be fixed to the fan panel 410, are formed by bending common end portions of the spacer mounting surface 421, the bottom portion 422, and the side portion 423 outward. Further, reinforcing ribs are formed by bending the ends of the spacer mounting surface 421, the bottom portion 422, and the side portion 423 as well as the peripheries of the air holes. Furthermore, a substantially triangular pyramid-shaped protrusion 421*d* for positioning the spacer 460 is formed at the bent portion of the reinforcing rib 421*c* of the spacer mounting surface 421.

In order to mount the motor support 420 to the inside of the fan panel 410, the mounting portions 421*b*, 422*b*, and 423*c* are fixed on the reinforcing plate 412, which has already been attached to the inside of the fan panel 410 by screws 471. Accordingly, the motor support 420 is mounted on the inside of the fan panel 410 so as to protrude inwardly. When the motor 430 is mounted on the motor support 420, a large deformation load is applied to the fan panel 410. However, since the thickness of the portion of the fan panel 410 supporting the motor doubles with the reinforcing plate 412, the fan panel can sufficiently bear the load.

The fan cover 450 is attached to the inside of the fan panel 410 by screws (not shown) so as not to interfere with the fan 440. A similar discharge port is formed in the fan cover 450 at a position corresponding to the discharge port 411 of the fan panel 410.

As shown in FIG. 6, the spacer 460 is formed by bending a metal plate into a U shape, and includes a top portion 461 and side portions 462 and 463 such that when the top plate 150 is mounted thereonto, the top portion 461 comes into abutment with said top plate. Air holes 462*a* and 463*a* are formed in both side portions 462 and 463 of the spacer 460 so as not to interrupt airflow generated by the fan 440. Further, mounting portions 462*b* and 463*b*, which are to be fixed to the spacer mounting surface 421 of the motor support 420, are formed by bending the lower ends of the both side portions 462 and 463 inwardly. Furthermore, a substantially triangular hole 463*c* is formed in the bent portion of the mounting portion 463*b* of the side portion 463 to give the spacer 460 the proper positions when the spacer 460 is to be mounted to the motor support 420.

In order to mount the spacer 460 to the motor support 420, the spacer and the motor support are completely positioned by fitting the protrusion 421*d* for positioning the spacer mounting surface 421 of the motor support 420 into the hole 463*c* for positioning the spacer 460. Then, as shown in FIG. 6, the mounting portions 462*b* and 463*b* of the spacer 460 are fixed to the spacer mounting surface 421 of the motor support 420 by screws 472.

As shown in FIG. 5, after being separately assembled in advance, the respective fan units 400A and 400B are mounted inwardly of the front plate 110 by manually holding the handle portion 414 of the fan panels 410 and lowering said respective fan units from above so that the both edges of the fan panels are guided by the vertical rails 113 formed inwardly of the front plate 110 to face each other.

Figure 2:
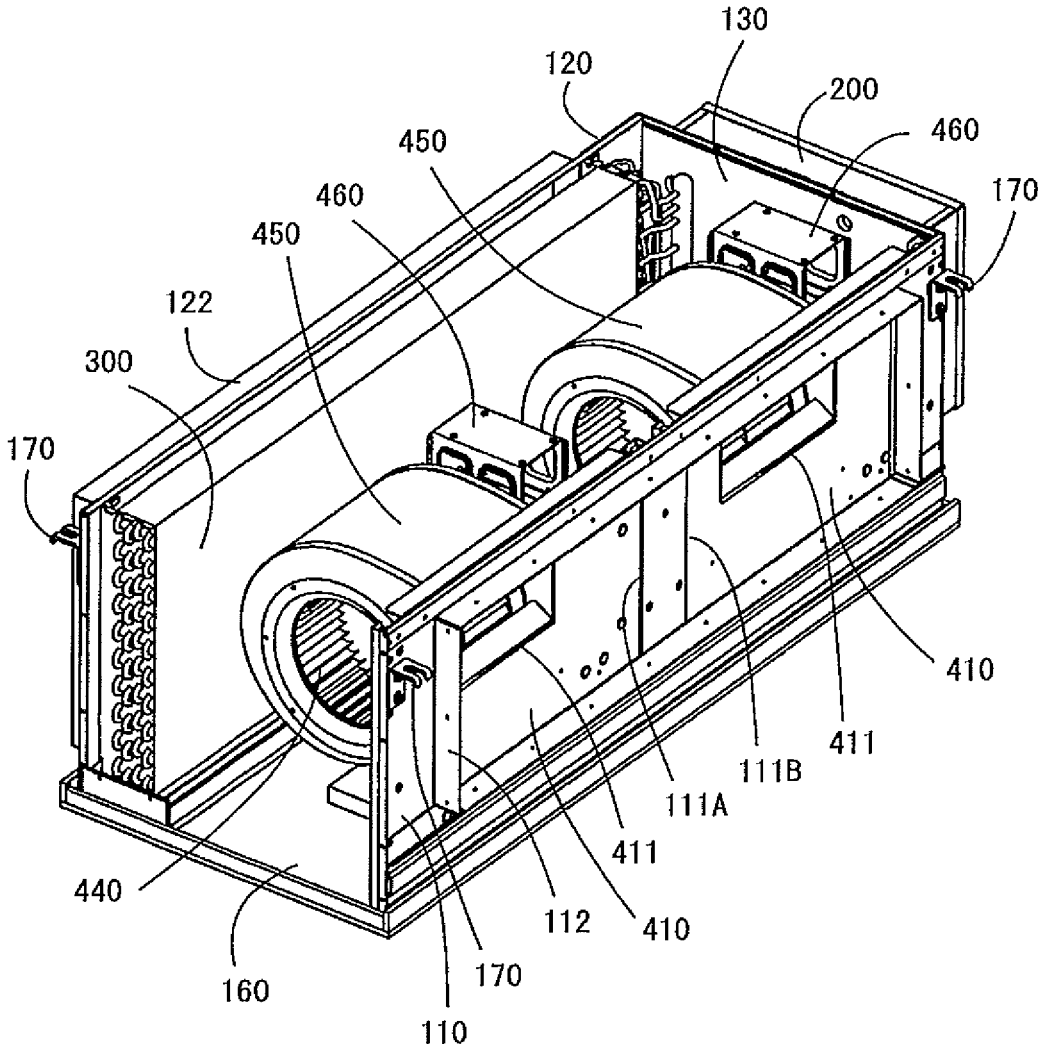
FIG. 2 is a perspective view of the duct type air conditioner from which a top plate and a left side plate are removed.
Figure 7:
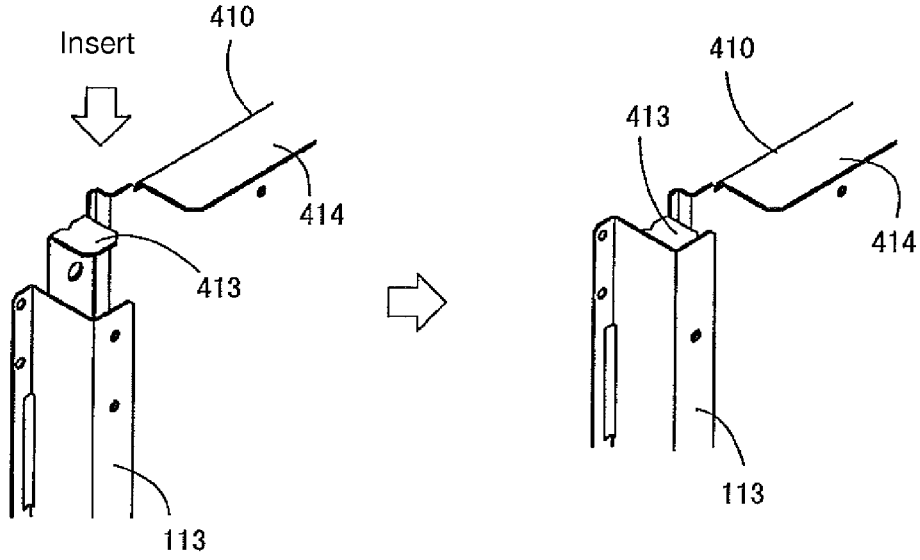
FIG. 7 is a view illustrating a mechanism for maintaining the posture of a fan panel of the duct type air conditioner.

In this case, the lower edge of each fan panel 410 rides the inclined surface portion 114*a* of the panel retainer 114 and slides forwardly while being guided downwardly to fit into the stopper portion 114*b*. Further, as shown in FIG. 7, the press portions 413, which are formed at both sides of the upper end of the fan panel 410, are pushed down into the vertical rails 113 such that the entire fan panel 410 is pressed against the front plate 110 provided forwardly thereof. Further, each of the fan panels 410 is fixed to the front plate 110 inwardly thereof by screws 473 such that the fan units 400A and 400B are assembled with the front plate 110. Therefore, as shown in FIGS. 1 and 2, the discharge ports 411 of the fan units 400A and 400B and the fans 440, which are provided in the casing, are exposed to the outside through the discharge openings 111A and 111B.

As described above, the fan mechanism requiring relatively heavy motors and formed of the fan units 400A and 400B that have the same structure are provided on two divided fan panels, respectively. Accordingly, the entire fan mechanism is downsized in comparison with a fan unit having the same air discharge performance with one motor and two fans, and the total weight of each of the fan units may thus be reduced by half. As a result, it is easier to handle and assemble the fan units. Further, a required die may be downsized such that initial investment can also be reduced. Furthermore, at the time of repair, the screws 473 used for a broken fan unit of the fan units 400A and 400B are removed and only a broken fan unit may be separated from the front plate 110 by manually holding the handle portion 414 with fingers to lift the broken fan unit. After the repair, it is also easy to perform a maintenance service.

In addition, when the lower edges of the fan panels 410 of the fan units 400A and 400B are inserted until coming into contact with the panel retainers 114 while the fan panels are guided by the vertical rails 113 from the upper side thereof formed on both sides of the front plate 110 and the press portion 413 of the fan panels 410 are then pushed down into the vertical rails 113, the fan units 400A and 400B are completely mounted on the inside of the front plate 110. Accordingly, it is easier to mount the fan units 400A and 400B on the inside of the front plate 110. Further, since the fan panel 410 is mounted at a regular position while being pressed against the inside of the front plate 110, screw holes of the front plate 110 naturally correspond to screw holes of the fan panels 410. As a result, screw insertion and tightening work is facilitated.

Figure 4:
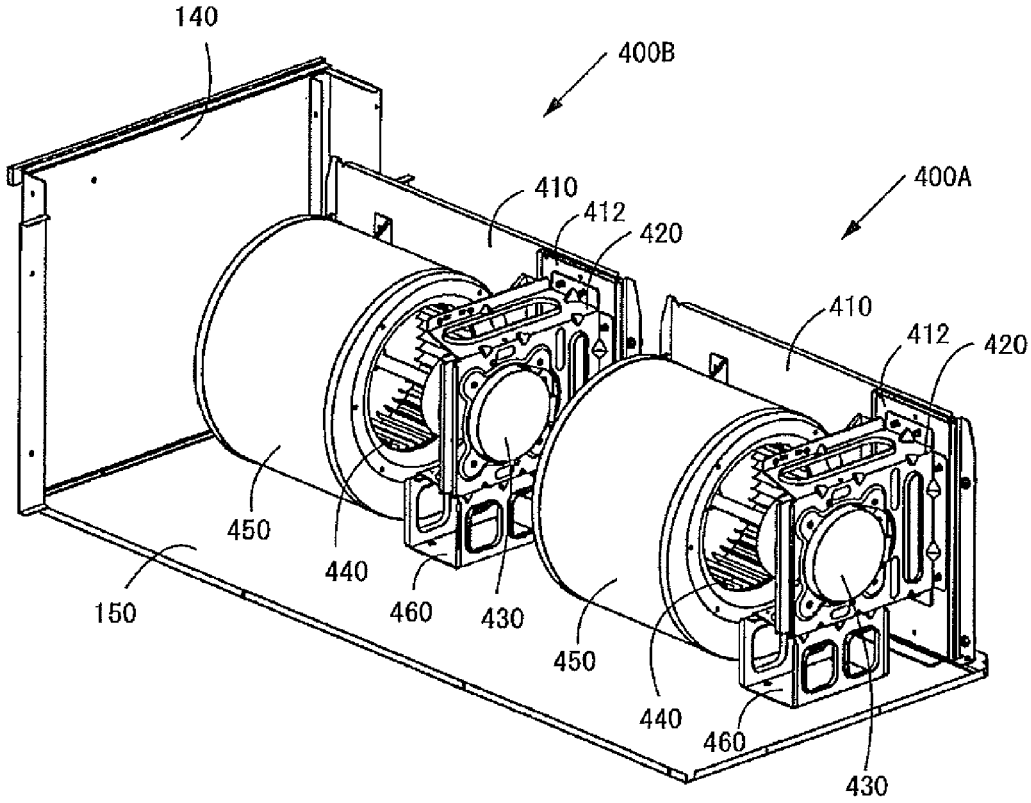
FIG. 4 is a perspective view of fan units provided in the duct type air conditioner and turned upside down.

Further, there are times when the duct type air conditioner is needed to be turned upside down at the time of assembling or conveyance after completion of the assembling operation. If, however, a drop accident occurs due to a certain cause when the duct type air conditioner is turned upside down, large impact loads are applied to the fan panels 410 by the weight of the motors 430 of the fan units 400A and 400B. In such a case, there is a risk of the motor supports or the fan panels 410 being deformed to cause deviation to occur in the shafts of the motors 430 and the fans 440. In this embodiment, since the spacers 460 are mounted on the spacer mounting surfaces 421 of the motor supports 420, the spacers 460 are interposed between the top plate 150 and the motor supports 420 as shown in FIG. 4. Accordingly, the spacers 460 and the top plate 150 bear the impact loads. As a result, it may be possible to prevent the motor supports or the fan panels 410 from being deformed and to prevent deviation in the shafts of the motors 430 and the fans 440.

Meanwhile, in the case the bottom plate 160 is to maintain the lower position by serving as a bottom even at the time of conveyance as at the time of installation, the motor and the fan are likewise completely protected even in a drop accident the spacer 460 is mounted on the surface of the motor support 420 facing the bottom plate 160 because the spacer 460 supports the motor support 420 against the bottom plate 160.

Further, in the above-mentioned embodiments, the heat exchange of the air sucked from the back plate 120 has been performed by the heat exchanger 300 through the operation of the fan units 400A and 400B and the air has then been discharged out of the front plate 110. However, the heat exchange of the air sucked from the front plate 110 may be performed by the heat exchanger 300 through the operation of the fan units 400A and 400B and the air may then be discharged out of the back plate 120. In this case, the discharge openings 111A and 111B serve as the suction opening 121 and the suction opening 121 serves as the discharge openings. Further, the discharge duct mounting frame 112 serves as the suction duct mounting frame, and the suction duct mounting frame 122 serves as the discharge duct mounting frame.

What is claimed is:

1. A duct type air conditioner comprising at least: a casing having discharge openings and a suction opening therein, said casing being composed of a front plate formed with a discharge duct mounting frame outwardly thereof so as to surround said discharge openings; a fan mechanism mounted inwardly of said front plate by way of a fan panel interposed therebetween; said casing being further composed of a back plate formed with a suction duct mounting frame outwardly thereof so as to surround said suction opening; and a heat exchanger mounted inwardly of said back plate, wherein said fan mechanism includes a plurality of fan units each having a fan panel which is planar and comprises a discharge port having a size smaller than said discharge openings of the front plate to be positioned in each of discharge openings of the front plate, and a motor mounted on the fan panel to drive each of the plurality of fan units, and each of the plurality of fan units is mounted inwardly of each of the discharge openings of the front plate by mounting the fan panel inwardly on the front plate respectively.

2. The duct type air conditioner according to claim 1, wherein the motors and the fans that are mounted to each of the fan units are substantially identical.

3. The duct type air conditioner according to claim 1, wherein the motors of the respective fan units are mounted on the back surfaces of the separate fan panels by motor supports.

4. The duct type air conditioner according to claim 1, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

5. The duct type air conditioner according to claim 2, wherein the motors of the respective fan units are mounted on the back surfaces of the separate fan panels by motor supports.

6. The duct type air conditioner according to claim 2, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

7. The duct type air conditioner according to claim 3, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

8. The duct type air conditioner according to claim 5, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

9. The duct type air conditioner according to claim 1, wherein the fan units comprises: motor supports mounted inwardly of said fan panels; and spacers mounted to said motor supports.

10. The duct type air conditioner according to claim 1, wherein the fan units comprises: reinforcing plates mounted inwardly of said fan panels; and motor supports mounted to said reinforcing plates.

* * * * *